United States Patent [19]

Nagashima

[11] Patent Number: 4,538,931

[45] Date of Patent: Sep. 3, 1985

[54] DRIVE MECHANISM INCLUDING A ONE-WAY SPRING CLUTCH FOR A TYPEWRITER

[75] Inventor: Yoshimitsu Nagashima, Kodaira, Japan

[73] Assignee: Silver Seiko Ltd., Tokyo, Japan

[21] Appl. No.: 455,592

[22] Filed: Jan. 4, 1983

[30] Foreign Application Priority Data

Jan. 18, 1982 [JP] Japan ..... 57-5023

[51] Int. Cl.[3] ..... B41J 23/00

[52] U.S. Cl. ..... 400/185; 400/144.2; 400/157.1; 400/187; 400/212; 400/225; 400/697.1; 400/196.1; 400/208; 74/125.5; 192/12 BA; 192/41 S

[58] Field of Search ..... 400/185, 186, 187, 155, 400/154.5, 163, 163.1, 212, 222, 225, 258, 259, 260, 310, 314.6, 317.3, 322, 365, 377, 378, 568, 569, 144.2, 157.1, 196.1, 697.1, 208; 74/111, 112, 125.5; 192/41 R, 12 BA, 41 S

[56] References Cited

U.S. PATENT DOCUMENTS

| | | | |
|---|---|---|---|
| 1,480,698 | 1/1924 | Shiek | 400/378 |
| 2,885,042 | 5/1959 | Frechette | 192/12 BA |
| 3,835,972 | 9/1974 | Helander | 192/12 BA X |
| 3,837,450 | 9/1974 | Malion et al. | 192/12 BA |
| 4,055,935 | 11/1977 | Malion et al. | 192/12 BA X |
| 4,061,219 | 12/1977 | Nishikawa et al. | 400/225 X |
| 4,079,298 | 3/1978 | Prager | 400/322 X |

OTHER PUBLICATIONS

IBM Technical Disclosure Bulletin, "Modular Increment Clutch", Overton, vol. 21, No. 2, Jul. 1978, pp. 471–472.

IBM Technical Disclosure Bulletin, "Spring Clutch Control Mechanism, Crutcher et al., vol. 21, No. 4, Sep. 1978, pp. 1527–1529.

IBM Technical Disclosure Bulletin, "Modified Wrap Down Spring Clutch for Typewriters and the Like", Shuman, vol. 22, No. 10, Mar. 1980, pp. 4641–4641.

*Primary Examiner*—Ernest T. Wright, Jr.

*Attorney, Agent, or Firm*—Ziems, Walter & Shannon

[57] ABSTRACT

A drive mechanism for a member to be driven in one direction is disclosed. The mechanism is incorporated in an electronic typewriter and includes a clutch including a clutch spring which provides a driving connection between a small DC motor and the member to be driven of the typewriter. Means is provided which normally holds a driven member of the clutch to a particular angular position and, when the motor is energized, it releases the driven member to allow the driven member to be rotated by the motor. After a cycle of rotation of the driven member, the holding means positively stops rotation of the second element and hence of the driving member and the motor.

A new and efficient ribbon feed mechanism is also disclosed which enables selective use of a carbon ribbon and a fabric ink ribbon depending upon a cassette mounted thereon.

7 Claims, 13 Drawing Figures

DRIVE MECHANISM INCLUDING A ONE-WAY SPRING CLUTCH FOR A TYPEWRITER

BACKGROUND OF THE INVENTION

This invention relates to a drive mechanism, and more particularly to a clutch-controlled drive mechanism well suitable for use with business machines such as electric or electronic typewriters or printers.

Power driven office machines such as, for example, electric typewriters, generally have a drive mechanism including an electric motor for cyclically driving a component of the machine. Such cyclically operable drive mechanisms typically include a constantly rotating drive shaft and a cycle clutch for operatively coupling the drive shaft to the machine component to drive the component in one direction for a cycle of operation. The electric motors used in such drive mechanisms have conventionally been AC motors which have a relatively large size but provide a relatively small torque output. AC motors are disadvantageously difficult to control appropriately so that they cannot be suitably employed for a drive mechanism of an electronic typewriter which has been very popular recently and requires a relatively or very precise control of machine components.

Stepping motors and servo motors are also very popularly used for drive mechanisms of office machines, due to their feasible and precise controllability. It is, however, disadvantageous in that they require such a high cost that they cannot be willingly incorporated in inexpensive popular business machines for office or personal use such as portable electronic typewriters.

Of late, small DC motors have exhibited a remarkable development and are very widely employed for drive mechanisms of business machines in accordance with individual applications. Small DC motors are advantageous in that they are inexpensive, easy to control and provide a relatively large output power or torque for their small size.

A portable electronic typewriter available on the market employs a small DC motor for its drive mechanism. Upon depression of a key of a typewriter keyboard, the DC motor is first energized and then a spring clutch is released to allow driving rotation of the motor to be transmitted to a member to be driven. After a cycle of rotation, i.e., a half rotation in the typewriter, of a driven element of the spring clutch, the clutch is rendered inoperative and then the motor is deenergized after a suitable interval of time. Thus, transmission of rotation is established sufficiently after the motor has reached its maximum speed, assuring the typewriter member to be driven satisfactorily by the motor. This arrangement, however, provides another problem that the motor produces disagreeable buzzing or even whizzing noises due to its rotation at a very high speed, sometimes up to about 6,000 rpm. These noises may cause an operator of the machine to be tired or irritated and may render her unwilling to use the machine.

SUMMARY OF THE INVENTION

It is an object of the present invention to provide a drive mechanism for a member to be cyclically driven in one direction which eliminates such drawbacks of conventional drive mechanisms and can be conveniently incorporated in business machines such as typewriters and printers.

It is another object of the invention to provide a drive mechanism which can employ a small DC motor as a drive source, resulting in considerable reduction of production cost of the mechanism, but produces little disagreeable buzzing or whizzing noises originating from such a DC motor.

It is a further object of the invention to provide a printer or a typewriter which includes a new and efficient drive mechanism for cyclically driving a print hammer actuating mechanism and a ribbon mechanism and can be produced at a reduced cost.

It is an additional object of the invention to provide an improved ribbon mechanism for a printer or a typewriter which can alternatively receive thereon a fabric ink ribbon cassette and a carbon ribbon cassette so as to allow a fabric ink ribbon and a carbon ribbon to be selectively used on the machine.

BRIEF DESCRIPTION OF THE DRAWING

The above description, as well as the objects, features, and advantages, or the present invention will be more fully appreciated by reference to the following detailed description of a presently preferred, but nonetheless illustrative, embodiment in accordance with the present invention, when taken in conjunction with the accompanying drawing wherein.

DETAILED DESCRIPTION OF THE PREFERRED EMBODIMENT

CARRIER

Figure 1:
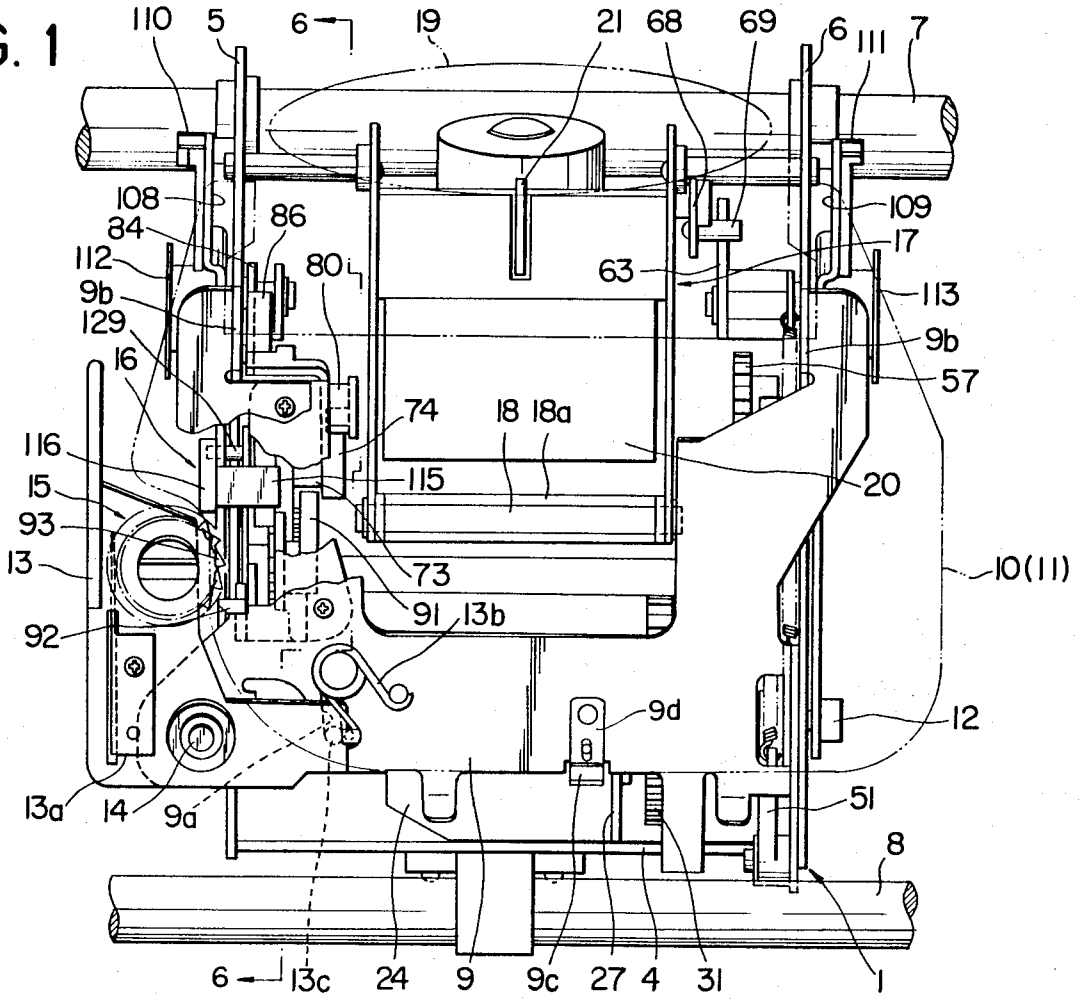
FIG. 1 is a top plan view, partly broken, of a carrier of a typewriter incorporating a drive mechanism according to the present invention.
Figure 2:
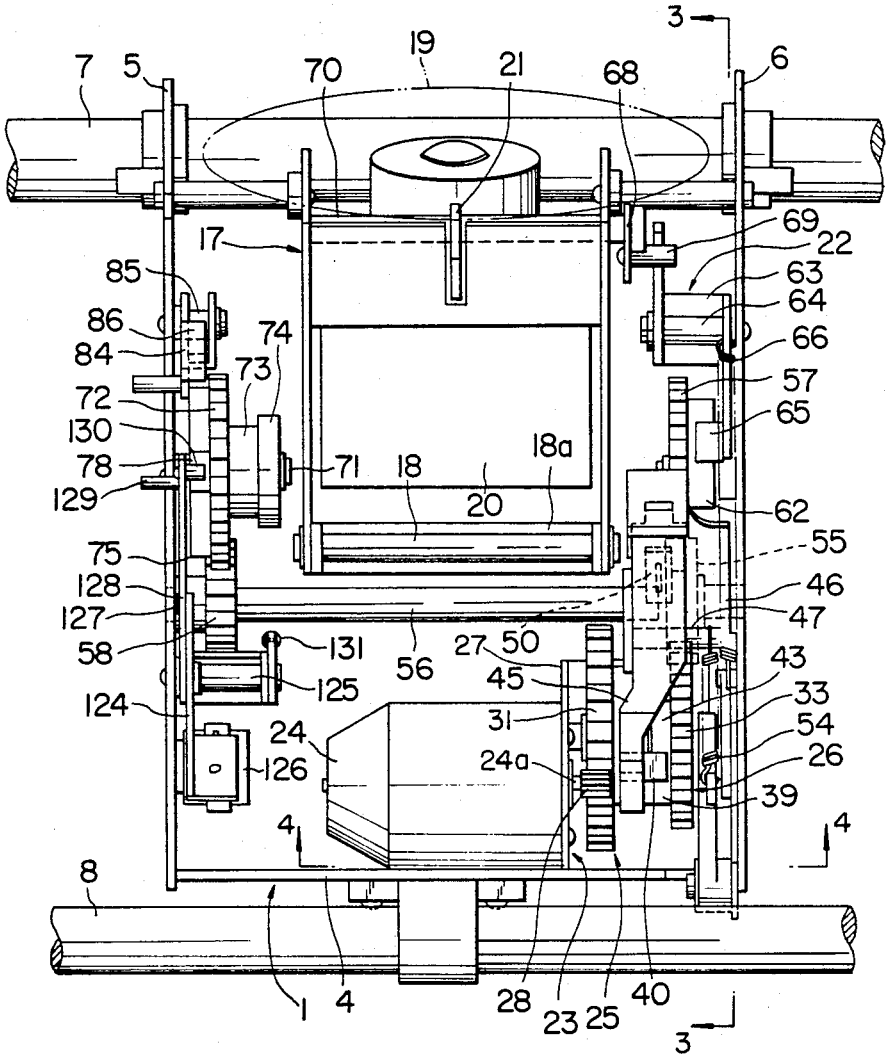
FIG. 2 is a top plan view of the carrier with a ribbon cassette platform omitted to show details of an arrangement of the drive mechanism.
Figure 3:
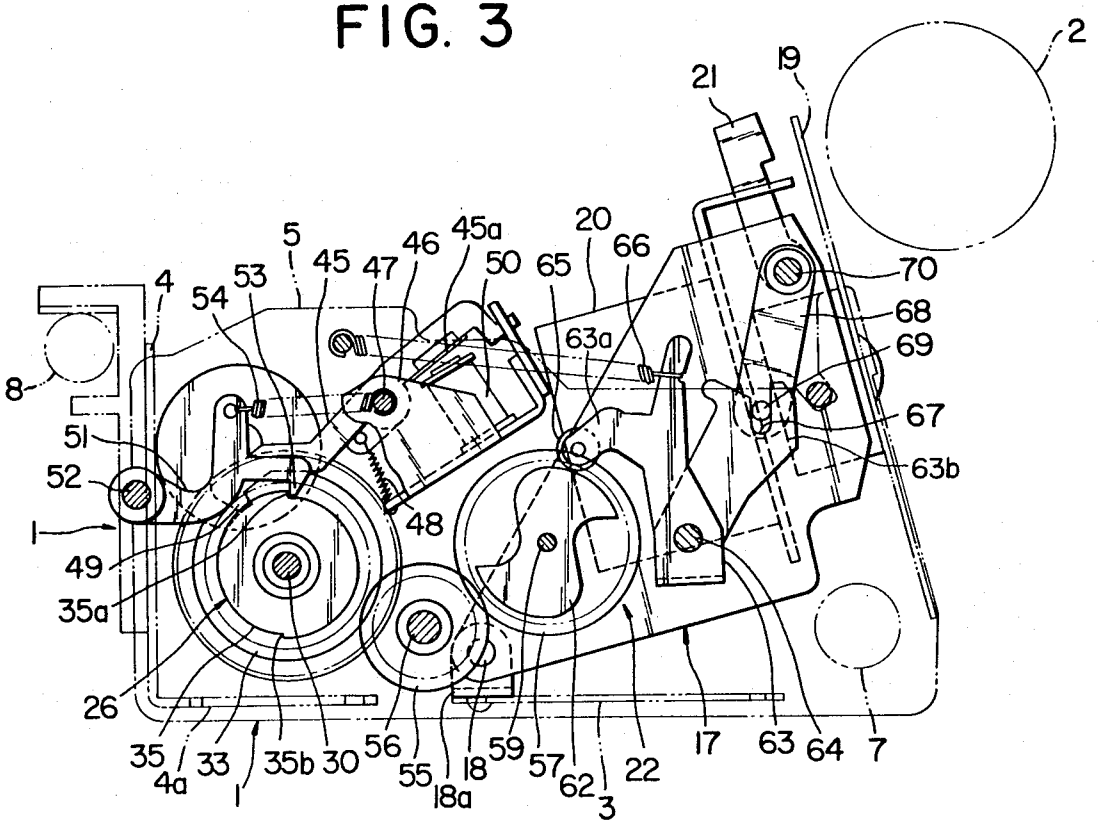
FIG. 3 is a cross sectional view, partly broken, takes along line 3—3 of FIG. 2, showing the drive mechanism and a print hammer actuating mechanism.
Figure 4:
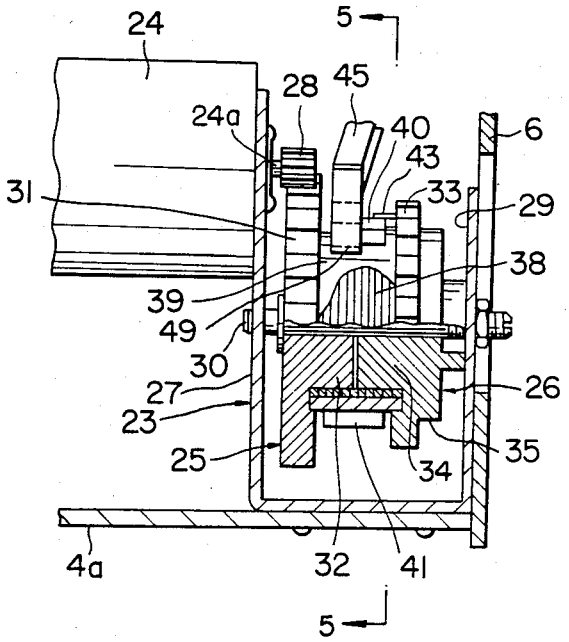
FIG. 4 is a transverse sectional view, partly broken, taken along line 4—4 of FIG. 2, showing details of the structure of the drive mechanism.

Referring first to FIGS. 1 to 3, there is illustrated a carrier of a typewriter incorporating a drive mechanism according to the present invention. The carrier is generally designated at 1 and is supported for transverse movement on a pair of guide rods 7 and 8 extending in parallel relationship with a platen 2. The carrier 1 has a frame structure including a bottom plate 3, a front plate 4, and left and right side plates 5 and 6. A platform 9 of a substantially U-shape in plan is disposed on the top of the carrier frame and is secured to a shaft 12 which has opposite ends thereof mounted for rotation on the left and right side plates 5, 6. The platform 9 supports thereon a ribbon cassette such as a carbon ribbon cassette 10 or a fabric ink ribbon cassette 11.

A lever 13 is supported for rotation about a pin 14 secured to a front left corner portion of the platform 9 and has a ribbon feed unit 15 mounted at a rear end thereof. A ribbon feeding and lifting mechanism 16 for a print ribbon 100, 102 and a correction ribbon 107 is provided on the left side plate 5 of the carrier frame.

An inner carrier section 17 is supported for rocking motion on a shaft 18 (FIG. 3) which is mounted on a bracket 18*a* secured to the bottom plate 3 of the carrier 1. The inner carrier section 17 has a stepping motor 20 mounted thereon for angularly positioning a daisy wheel type carrier 19 (shown in broken line illustration) to bring a selected type (not specifically shown) of the type carrier 19 to a print position. The selected type is impacted against a record medium (not shown) on the platen 2 by a print hammer 21 which is also mounted on the inner carrier section 17.

Meanwhile, the right side plate 6 of the carrier frame has a print hammer actuating mechanism 22 provided thereon. Adjacent the right side plate 6, a drive mechanism embodying the present invention is provided. In the system shown in the drawing, the drive mechanism is constituted as a drive mechanism which drives the ribbon feeding and lifting mechanism 16 and the print hammer actuating mechanism 22.

DRIVE MECHANISM

Referring now to FIGS. 2 to 5, the drive mechanism includes an electric motor 24 secured to a left upright wall 27 of a substantially U-shaped support bracket 23 which in turn is secured to a horizontal rear extension 4*a* of the front plate 4 of the carrier frame. The motor 24 may be a small DC motor available on the market and has an output shaft 24*a* which extends through the bracket wall 27. A gear 28 is mounted on the motor shaft 24*a* and is meshed with another gear 31 of a driving member 25 supported for rotation on a support shaft 30 which has opposite ends thereof supported on the left and right upright walls 27, 29 of the bracket 23. The driving member 25 has an integral cylindrical portion or hub 32 on the right side of the gear 31.

A driven member 26 is also supported for rotation on the support shaft 30. The driven member 26 includes a gear 33 which is meshed with another gear 55 operatively connected to both the print hammer actuating mechanism 22 and the ribbon feeding and lifting mechanism 16. The driven member 26 further has, on the left side of the gear 33, an integral hub 34 which has substantially the same outside diameter as that of the hub 32 of the driving member 25 and is located adjacent the hub 32 of the driving member 25. A coiled spring 38 surrounds the hubs 32, 34 of the driving and driven members 25, 26, respectively, and has opposite ends thereof left free. The spring 38 is coiled in continuous frictional engagement with the hubs 32, 34, thereby constituting a spring clutch.

Figure 5:
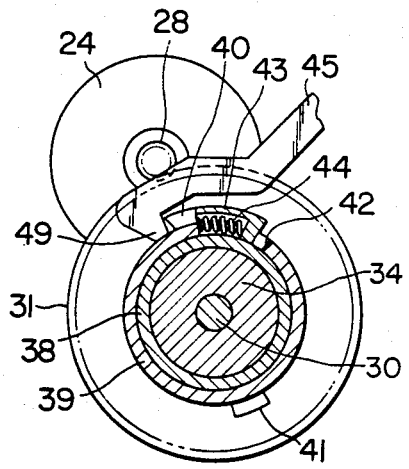
FIG. 5 is a cross sectional view taken along line 5—5 of FIG. 4.

Thus, if the motor 24 is energized in order to actuate the ribbon feeding and lifting mechanism 16 and the print hammer actuating mechanism 22, the driving member 25 is rotated in the counterclockwise direction as in FIG. 5 causing the coiled spring 38 to wind tightly on the hubs 32, 34 of the driving and the driven members 25, 26, respectively, so that the driven member 26 is rotated in the same direction, i.e., in the counterclockwise direction in FIG. 5; on the contrary, if the driving member 25 rotates in the opposite clockwise direction, it will expand the spring 38 so that the driven member 26 will not be rotated integrally by the driving member 25. On the other hand, it will be appreciated that, if the driven member 26 is rotated in the counterclockwise direction, it will expand the spring 38 so that the driving member 25 will not be rotated integrally by the driven member 26; on the contrary, if the driven member 26 is rotated in the opposite clockwise direction, the driving member 25 will be rotated integrally by the driven member 26. Thus, the clutch spring 38 acts to transmit the counterclockwise rotation of the driving member 25 to the driven member 26 and the clockwise rotation of the driven member 26 to the driving member 25, but rotation of the driving or driven member 25 or 26 in the respective opposite direction will not be transmitted to the other member by the clutch spring 38.

It is to be noted that the clutch spring 38 is coiled relatively weak such that it may allow a slip relative to the hub 32 and/or the hub 34 to provide a slight displacement between the driving and driven members 25, 26 when the driving member 25 starts or tends to rotate counterclockwise relative to the spring 38 in the free position.

A sleeve 39 is loosely fitted around the outer periphery of the spring 38 and has a pair of projections 40, 41 formed integrally at diamerically opposite positions thereon. An opening 42 is formed in the sleeve 39 adjacent the projection 40 in the clockwise direction (FIG. 5), and a projection 43 extends into the opening 42 from the left-hand side face (FIG. 4) of the driven member 26. The projection 43 presents a substantially L-shape in side elevation which cooperates with the sleeve 39 to define a spacing in which a coiled compression spring 44 is accommodated to extend in a circumferential direction on the spring 38. The compression spring 44 has opposite ends thereof contacted with a circumferential end face of the sleeve 39 defining the opening 42 and an inner end face of the projection 43 of the driven member 26 and thus exerts a force to angularly rotate the sleeve 39 and the driven member 26 in the counterclockwise and clockwise directions, respectively, to a position in which an outer end face of the projection 43 is abutted against the other circumferentical end face of the sleeve 39 defining the opening 42.

However, the driven member 26 is normally held to a particular angular position against the urging of the compression spring 44 by means of a lever 51. The lever 51 is mounted for pivotal motion on a pin 52 secured to a front portion of the right side plate 6 and is urged clockwise by a tension coil spring 54 to a position in which a hooked end 53 thereof is abutted against the outer periphery of a second hub 35 of the driven member 26. The hub 35 is constituted as a cam having a pair of cam lobes each having a gradually increasing radius in the clockwise direction to thus define a pair of shoulders 35*a* and 35*b* in opposite diametrical positions thereof. Thus, the driven member 26 is normally held from clockwise rotation by abutting engagement of the shoulder 35*a* or 35*b* of the hub 35 against the hooked end 53 of the lever 51.

Also, the sleeve 39 is normally held by a lever 45 to its normal position in which either one of the projections 40 and 41 is abutted by a hooked end 49 of the lever 45 and in which a small clearance remains between the outer end face of the projection 43 of the driven member 26 and the opposing end face of the sleeve 39 defining the opening 42, as seen in FIG. 5. The lever 45 has a mid portion thereof mounted for pivotal motion on a pin 47 secured to the right side plate 6 and is urged counterclockwise (FIGS. 3 and 5) by a tension coil spring 48 to a position in which the hooked end 49 thereof is abutted against the outer periphery of the first hub 34 of the driven member 26. A ferromagnetic element 45*a* is mounted on a portion of a bottom surface of the lever 45 adjacent the rear end in a spaced opposing relationship to a solenoid 50 mounted on a bracket 46. The bracket 46 is secured to the right side plate 6 by a suitable securing means not shown. Thus, if the solenoid 50 is energized, then the element 45*a* is attracted to the solenoid 50 to pivot the lever 45 clockwise about the pin 47 against the urging of the spring 48 to remove the hooked end 49 of the lever 45 from the projection 40 or 41 of the sleeve 39 thereby allowing the sleeve 39 to be angularly rotated in the counterclockwise direction by the urging of the compression spring 44.

OPERATION OF THE DRIVE MECHANISM

In operation, the solenoid 50 is first energized in response to completion of the selection of a character type of the type carrier 19 so that the lever 45 is pivoted clockwise to release the sleeve 39 therefrom thereby to allow the spring 44 to angularly rotate the sleeve 39 from its normal position as shown in FIG. 5 to a position limited by the projection 43 of the driven member 26 abutting against the opposing end face of the opening 42 of the sleeve 39. Then the motor 24 is energized to rotate the driving member 25 in the counterclockwise direction (FIGS. 3 and 5) about the shaft 30. The clutch spring 38 transmits this counterclockwise rotation of the driving member 25 to the driven member 26, which thus operates the print hammer actuating mechanism 22 and the ribbon feeding and lifting mechanism 16 coupled thereto. It is to be noted here that, upon starting of the rotation, the driving member 25 is angularly displaced slightly relative to the driven member 26 due to a slip between the spring 38 and the hubs 32, 34, as mentioned before.

During this rotation, the solenoid 50 is deenergized sufficiently before the sleeve 39 is rotated an angle of about 180 degrees, i.e., a half revolution. Consequently, the lever 45 is pivoted back to its initial position abutting the outer periphery of the hub 34 of the driven member 26 by the urging of the spring 48. In this position, the lever 45 is soon brought into abutment at the hooked end 49 thereof with the other one of the projections 40, 41 which has initially been remote from the lever 45 so that the sleeve 39 is positively stopped by the lever 45 after such a half revolution. The driven member 26, however, continues its counterclockwise rotation, due to inertia of the driven member 26 and the associated mechanisms, by a predetermined angle over which the sleeve 39 was first allowed to angularly rotate relative to the driven member 26. After the further angular rotation, during which the spring 44 is gradually compressed, the projection 43 of the driven member 26 is brought into abutment with the projection 40 or 41 of the sleeve 39 which is now in its stationary position stopped by the lever 45 and hence the driven member 26 and the associated mechanisms are suddenly and positively stopped thereby.

Due to the inertia of the driven member 26 and the associated mechanisms, such sudden stopping will normally produce a reaction to rotate the driven member 26 in the opposite clockwise direction. This clockwise rotation of the driven member 26 is stopped at once by means of the lever 51 (FIG. 3). In particular, just before the driven member 26 and the associated mechanisms are stopped by the sleeve 39 and the lever 45, the hooked end 53 of the lever 51 which has been gradually pivoted counterclockwise about the pin 52 following the outer periphery of the second hub 35 of the driven member 26 reaches and is released from the shoulder 35*a* or 35*b* of the hub 35 to allow the spring 54 to pivot the lever 51 clockwise to its initial position in which the hooked end 53 abuts against a minimum radial portion of the outer periphery of the hub 35. Thus, the following clockwise rotation of the driven member 26 is stopped positively by the engagement of the hooked end 53 of the lever 51 with the shoulder 35*a* or 35*b* of the second hub 35 of the driven member 26, and the driven member 26 is now in a position limited by the levers 45 and 51.

Meanwhile, when the driven member 26 is stopped, the driving member 25 and hence the motor 24 are also stopped by way of the clutch spring 38 whether the motor 24 is still energized or not. Since the driven member 26 may be rotating at its maximum speed attainable by the motor 24 and hence the spring 38 may be in its free position just before the driven member 26 is stopped, the driving member 25 will be permitted by a slip between the spring 38 and the hubs 32, 34 to further rotate slightly relative to the driven member 26 until the spring 38 comes to tightly grip the hubs 32, 34 as described before. Thus, the driving member 25 is further angularly displaced relative to the driven member 26. Since the stopping of the driving member 25 and the motor 24 is effected not so suddenly, a possible reaction to rotate the driving member 25 clockwise may not be significantly large, and as a result, the driving member 25 may remain at the further displaced angular position relative to the driven member 26.

In this way, each time the motor 24 is energized for a cycle of operation of the machine components such as the print hammer actuating mechanism 22 and the ribbon feeding and lifting mechanism 16, the driving member 25 is displaced by a predetermined angle relative to the driven member 26. This angular displacement of the driving member 25 results in a change of two teeth of the gears 28 and 31 which are engaged with each other and hence are subjected to a force of inertia, and added by a driving force as the case may be, of the motor 24, and a reactive force transmitted from the driven member 26 as the case may be, when the driving member 25 is stopped. This is advantageous in that, for a great number of repetitive operations, each of the gears 28 and 31 is subjected to such an impact force commonly over all the teeth thereof and concentration of stress can be eliminated accordingly.

It is to be noted that, although the motor 24 may be deenergized at any time around the instant at which the driving member 25 is stopped, it is preferable to stop energization just before the stopping of the driving member 25 in order to minimize the impact force applied to the gears 28, 31. In practice, the motor 24 may be controlled to have a predetermined fixed duration of energization sufficient to rotate the driven member 26 a half revolution for one cycle of operation of the associated mechanisms. Such a control can be attained, for example, by using a one shot multivibrator (not shown).

It is also to be noted that such an angular displacement between the driving and driven members, 25 and 26, can be also attained by an additional energization of the motor 24 for a shorter period of time for rotating the driving member 25 in the opposite direction; this reverse rotation is allowed while the driven member 26 is stopped, as apparent from the foregoing description, and hence the driving member 25 is angularly displaced relative to the driven member 26 but in the opposite direction.

It is further to be noted that the preferred embodiment of the invention may be replaced by any other suitable arrangement which has a one-way power transmission function, such as, for example, a free wheel coupling and a transmission gear of the type including a ratchet wheel and a feed pawl (not shown). However, it will be appreciated that, in consideration of the cost and the design feasibility, a power transmission of the type described above utilizing driving and driven members, 25 and 26, selectively coupled by a spring 38 is the best for the drive mechanism of the present invention.

PRINT HAMMER ACTUATION

Referring to FIGS. 2 and 3, the gear 55 is secured to a transverse shaft 56 which is supported at opposite ends thereof for rotation on the left and right side plates 5, 6 of the carrier frame and is operatively coupled to the ribbon feeding and lifting mechanism 16. The gear 55 on the shaft 56 is further meshed with a gear 57 of the print hammer actuating mechanism 22. The gear 57 is mounted for rotation on a pin 59 secured to the right side plate 6 and has a hammer actuating cam 62 integrally formed thereon. The gear 57 has the same diameter as the gear 33 of the driven member 26 so that a half rotation of the driven member 26 will cause a half rotation of the gear 57 and the cam 62. A bellcrank 63 is mounted for pivotal motion on a pin 64 secured to the right side plate 6 and has a roller 65 mounted at an end of a first arm **63*a* thereof. The bellcrank 63 is urged counterclockwise by a tension coil spring 66 to a position in which the roller 65 is abutted against the cam 62 for operation thereby. The bellcrank 63 has second arm 63*b* which has an elongated slot 67 formed at an end thereof which receives therein a pin 69 secured to a lever 68. The lever 68 is secured to a shaft 70 which is supported for rotation on the side plates 5, 6 and has the hammer 21** secured thereto.

Referring to FIG. 3, the cam 62 has a pair of symmetrical cam profiles and the roller 65 of the bellcrank 63 is normally located on a high lobe portion of either one of the cam profiles to thus keep the hammer 21 in its home position spaced from the platen 2 and the type carrier 19 as seen in FIG. 3. Upon a half rotation of the cam 62 for a cycle of operation, the roller 65 is first released suddenly from the high lobe portion of the cam profile to allow the spring 66 to pivot the bellcrank 63 counterclockwise about the pin 64 thereby to pivot the print hammer 21 clockwise by way of the pin and slot connection 69, 67, the lever 68 and the shaft 70 for printing a character on a record sheet (not shown) supported on the platen 2. During the remaining part of the half rotation of the cam 62, it gradually pivots the bellcrank 63 clockwise against the urging of the spring 66 to thus pivot the print hammer 21 counterclockwise back to its home position.

PRINT RIBBON FEED AND LIFT

Figure 6:
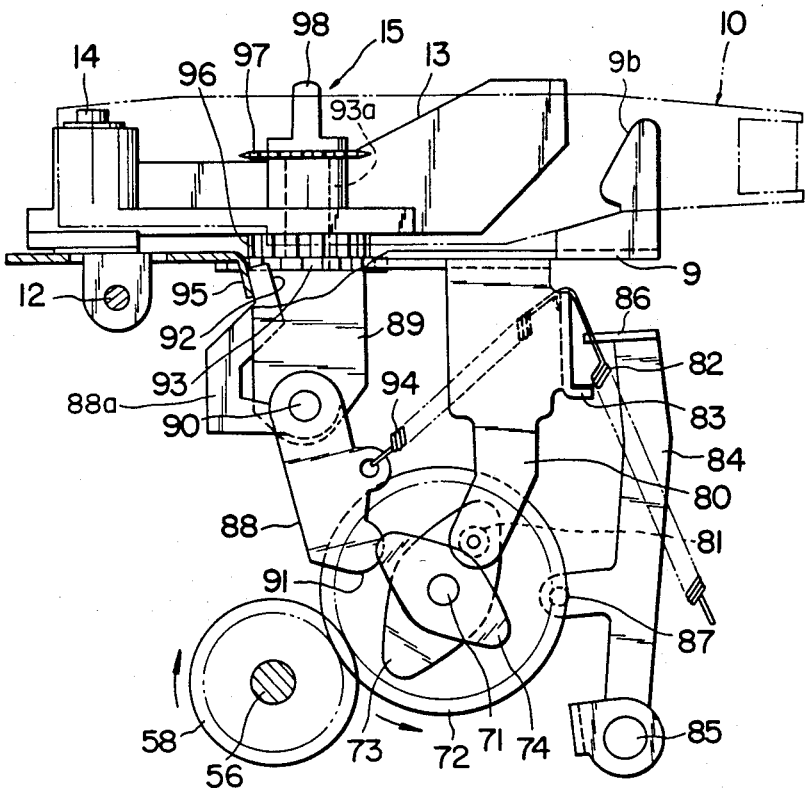
FIG. 6 is a sectional view taken along line 6—6 of FIG. 1, showing details of a print ribbon lift mechanism of the typewriter.

Referring now to FIGS. 1, 2 and 6, the ribbon feeding and lifting mechanism 16 includes a gear 58 secured to the shaft 56 adjacent the left side plate 5 of the carrier frame. The gear 58 has the same diameter as the gear 33 of the driven member 26 so that a half rotation of the driven member 26 for a cycle of operation will cause a half rotation of the gear 58. The gear 58 is meshed with another gear 72 mounted for rotation on the left side plate 5 by means of a pin 71. The gear 72 has an elliptical feed cam 73 and a similar rather small lift cam 74 integrally formed on the right-hand side thereof and a correction cam 75 integrally formed on the left side thereof (see also FIG. 7).

A cam follower member 80 has a roller 81 mounted at a lower end thereof which is in registration with the lift cam 74 for operation thereby. The member 80 has its top end secured to the bottom of the platform 9 and is urged, together with the platform 9, clockwise about the shaft 12 by a tension coil spring 82 to engage the roller 81 with the lift cam 74. The member 80 has a bent lug 83 formed thereon over which a bent lug 86 of a lever 84 is located. The lever 84 has a lower end thereof mounted for pivotal motion on the left side plate 5 by means of a pin 85 and has a pin 87 secured to a horizontal extension formed at a mid portion thereof.

Located in registration with the feed cam 73 is a first arm 91 of a print ribbon feed lever 88 which has a mid portion thereof mounted for pivotal motion about a pin 90 secured to a bracket 89. The bracket 89 is formed as an integral part of the cam follower member 80 and extends downwardly from the bottom of the platform 9. The ribbon feed lever 88 is urged counterclockwise (FIG. 6) about the pin 90 by means of a tension coil spring 94 to engage a second arm **88*a* thereof with a bent lug 95 of the platform 9 acting as a stop for the ribbon feed lever 88. The second arm 88*a* of the ribbon feed lever 88 has a feed pawl 92 at its top end located adjacent a toothed periphery of a ratchet wheel 93 of the ribbon feed unit 15 for operation of the same (see FIGS. 1 and 6**).

Figure 8:
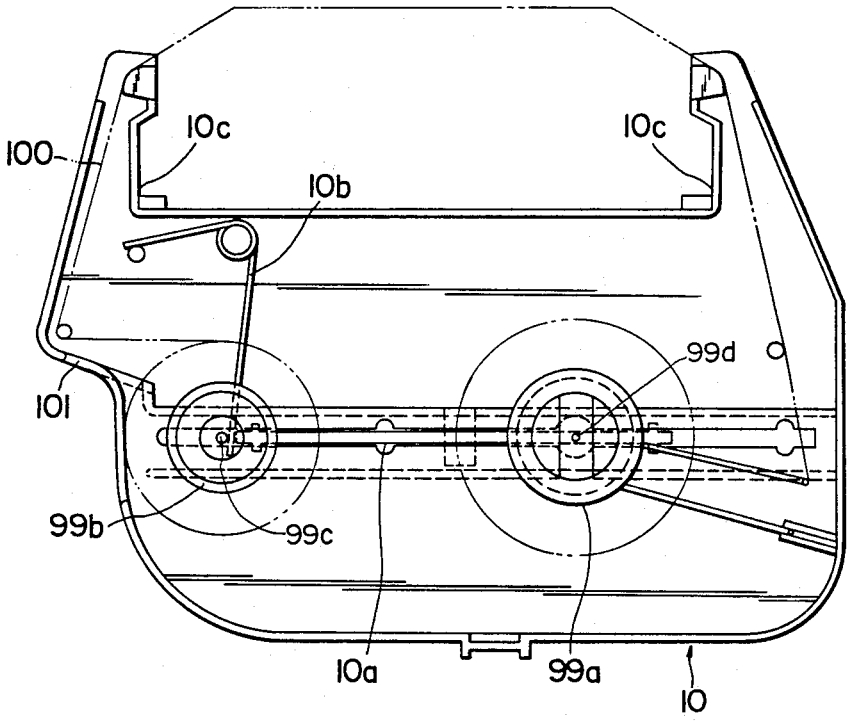
FIG. 8 is a top plan view of a carbon ribbon cassette with a top cover removed to show details of the structure within the cassette.
Figure 9:
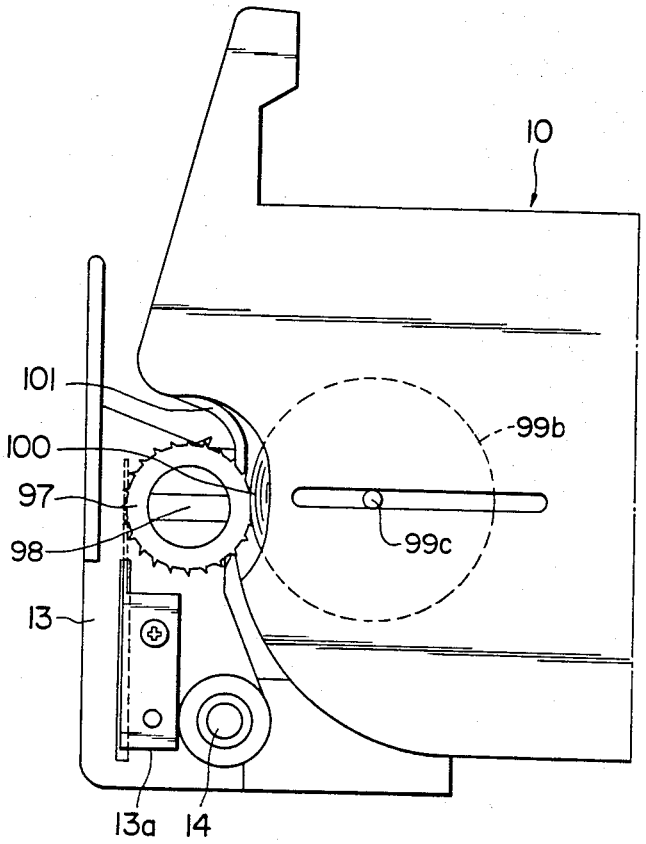
FIG. 9 is a top plan view illustrating cooperation of a ribbon feed unit with the carbon ribbon cassette for feeding a carbon ribbon.
Figure 12:
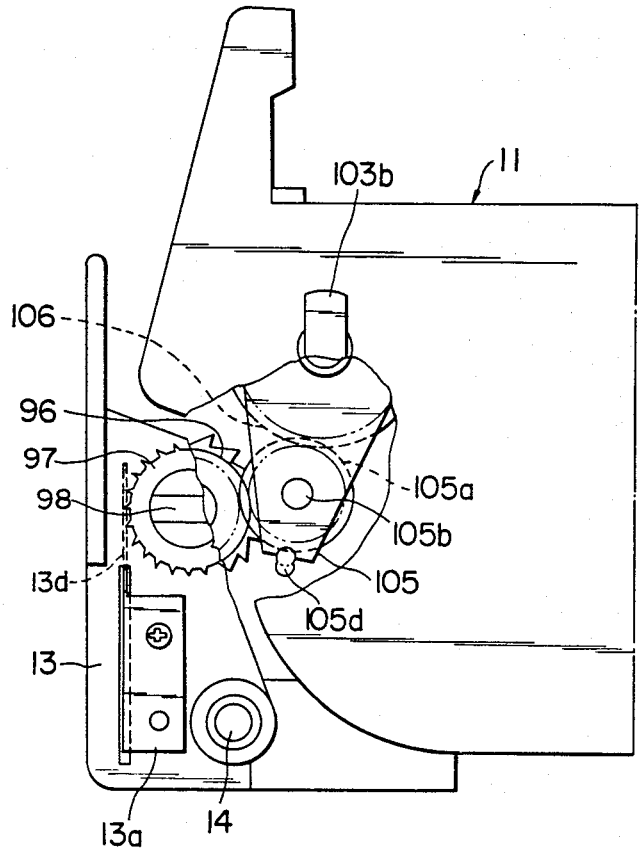
FIG. 12 is a top plan view, partly broken, illustrating cooperation of the ribbon feed unit with the fabric ink ribbon cassette for feeding a fabric ink ribbon.

Referring also to FIGS. 6, 9 and 12, the ratchet wheel 93 is secured to a shaft **93*a* (shown in dotted line illustration in FIG. 6) which extends through and is supported for rotation on the lever 13. A gear 96 is securely mounted on the shaft 93*a* between the lever 13 and the ratchet wheel 93 for cooperation, as described below, with a fabric ink ribbon cassette 11 for feeding the fabric ribbon 102 (FIG. 10) while a toothed wheel 97 is securely mounted adjacent the top of the shaft 93*a* above the lever 13 for engagement with a carbon ribbon 100 (FIG. 8) within a carbon ribbon cassette 10 for feeding the same. A knob 98 is secured to the top end of the shaft 93*a* for manual feeding of the fabric or carbon ribbon 102, 100. A spring plate 13*a* is secured to the lever 13 and has a finger 13*d* which resiliently engages with the outer periphery of the ratchet wheel 93 to provide a detent to the ratchet wheel 93** and the associated elements.

Upon a half rotation of the gear 72 in the counterclockwise direction as in FIG. 6, the feed cam 73 integral with the gear 72 is first engaged with the first arm 91 of the feed lever 88 and pivots the lever 88 clockwise about the pin 90 against the urging of the spring 94 whereupon the feed pawl 92 at the top end of the second arm 88*a* of the lever 88 is engaged with the ratchet wheel 93 and rotates the same by a predetermined angle about its axis thereby to cause a fabric ink ribbon 102 or a carbon ribbon 100 to be fed by a predetermined distance. The feed lever 88 is thereafter allowed to be pivoted counterclockwise to its initial angular position by the spring 94. In the meantime, the lift cam 74 also operates, substantially in simultaneously timed relationship with the feed cam 73, the member 80 to pivot the platform 9 and the ribbon cassette 10 or 11 thereon counterclockwise about the axis of the shaft 12 to lift a segment of a carbon ribbon 100 or a fabric ribbon 102 in position for allowing printing of a character. A possible excessive counterclockwise pivotal motion of the platform 9 will be prevented by the engagement of the lug 83 of the member 80 with the lug 86 of the lever 84. After printing, the platform 9 and the member 80 are allowed to be pivoted clockwise back to their initial position by the spring 82. In practice, the pivotal motion of the feed lever 88 is complicated by the pivotal motion of the platform 9 in that the feed lever 88 is pivoted about its axis which is being moved by the platform 9.

Referring now to FIG. 1, the lever 13 for the ribbon feed unit 15 is mounted for pivotal motion around the pin 14, as described hereinbefore. An overcenter spring 13*b* is connected to urge the lever 13 about the pin 14 to two alternative limit positions which are defined by a slot 9*a* formed in the platform 9 through which a downward protrusion 13*c* of the lever 13 extends. Thus, in the first limit position of the lever 13, the ribbon feed unit 15 is located adjacent the ribbon cassette 10 or 11 mounted on the platform 9 for operation thereof and the ratchet wheel 93 is located adjacent the feed pawl 92 of the feed lever 88 for operation thereby, as seen in FIG. 1. On the other hand, a manual counterclockwise pivotal motion of the lever 13 beyond a particular angular position or dead center line will cause the spring 13*b* to further pivot the lever 13 counterclockwise to the second limit position thereof in which the ribbon feed unit 15 is spaced far away from the feed pawl 92 and from the ribbon cassette 10 or 11 for facilitating exchanging of the ribbon cassette 10 or 11.

CARBON RIBBON CASSETTE

Referring to FIGS. 8 and 9, there is illustrated a carbon ribbon cassette 10 embodying the present invention. In FIG. 8, the ribbon cassette 10 is shown with a top wall removed to illustrate details of the structure inside the cassette 10. The ribbon cassette 10 includes a supply spool 99*a* having a fixed axis 99*d* of rotation and a takeup spool 99*b* having a movable axis 99*c* of rotation. The takeup spool 99*b* is supported for rotation on a bent end of a rod 10*a* which is suitably mounted for transverse longitudinal movement on a lower casing of the cassette 10. A torsion spring 10*b* acts on the bent end of the rod 10*a* to urge the rod 10*a* and the takeup spool 99*b* transversely leftwardly to a position in which an outer periphery of a carbon ribbon 100 wound on the takeup spool 99*b* abuts against the inner surface of a left-hand side wall of the lower casing, as seen in FIG. 8. Material is removed from a portion of the left side wall adjacent the takeup spool 99*b* to define an opening 101 which extends downwardly to substantially a half of the height from the top of the cassette 10.

Referring also to FIG. 1, in mounting the cassette 10 on the platform 9, the lever 13 is first pivoted manually in the counterclockwise direction to the second limit position and then the cassette 10 is mounted in position on the platform 9. The cassette 10 is retained in position by means of a pair of hooked posts 9*b* formed on opposite rear end portions thereof which are located adjacent opposite inner rear corners 10*c* of the cassette 10. An upright angle finger 9*c* of a plate spring 9*d* secured to a front portion of the platform 9 acts on the front face of the cassette 10 to resiliently press the cassette 10 rearwardly. In this position of the cassette 10, the lever 13 is manually pivoted back to its first limit position.

When the cassette 10 is in position on the platform 9 and the lever 13 is in its first clockwise limit position, a portion of the toothed wheel 97 extends into the cassette 10 through the opening 101 and is engaged with the outer periphery of the ribbon 100 wound on the takeup spool 99*b*. Consequently, if the ribbon feed unit 15 is rotated a predetermined angle in the counterclockwise direction in FIG. 9, the wheel 97 drives the ribbon 100 in the clockwise direction about the axis of the spool 99*b* so that a segment of the ribbon 100 of a predetermined length is taken up on the spool 99*b*. It is to be noted that a force of the spring 13*a* is sufficiently strong for the lever 13 to be retained to its first clockwise limit position against a force of the spring 10*b* for urging the takeup spool 99*b* against the toothed wheel 97 and as the ribbon 100 is accummulated on the spool 99*b*, the spool 99*b* is moved rightwardly in FIG. 8 against the urging of the spring 10*b*.

FABRIC INK RIBBON CASSETTE

Figure 10:
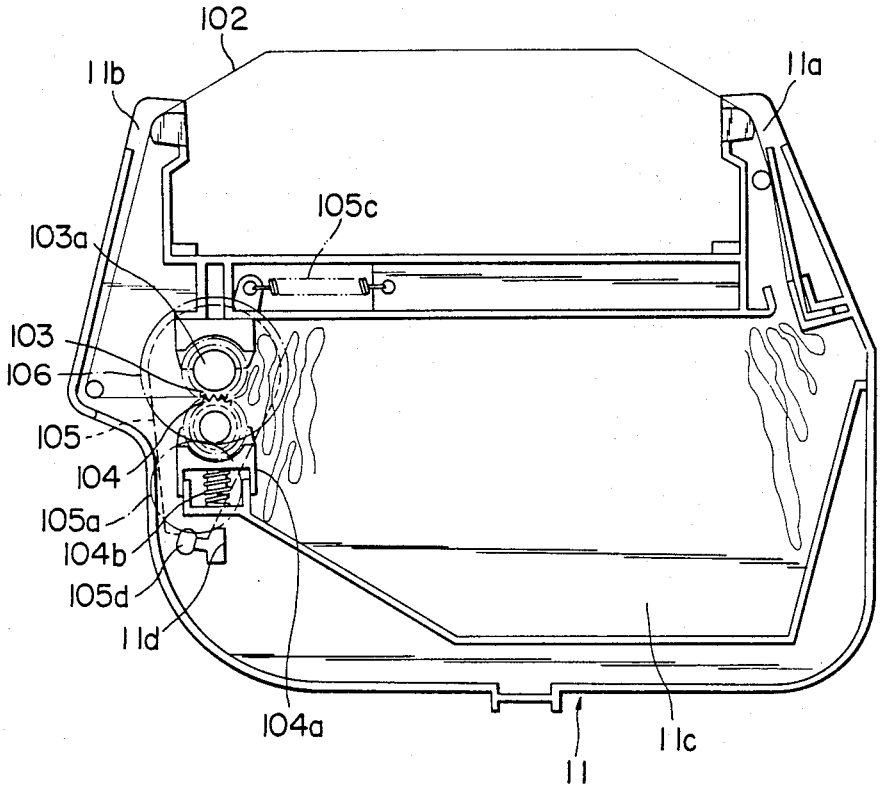
FIG. 10 is a top plan view of a fabric ink ribbon cassette with a top cover removed to show details of the internal structure of the cassette.
Figure 11:
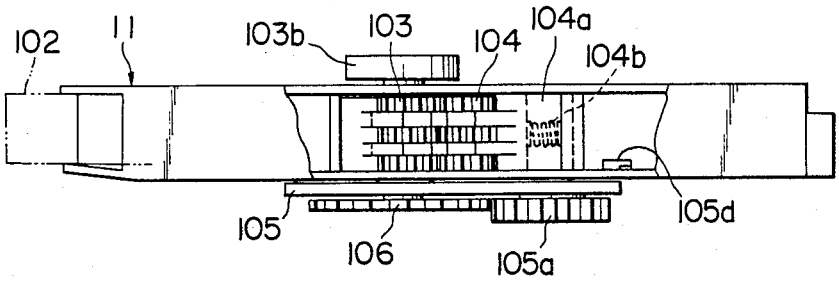
FIG. 11 is a left-hand side elevational view, partly broken, of the fabric ribbon cassette.

Referring to FIGS. 10 to 12, there is illustrated a fabric ink ribbon cassette 11. In FIG. 10, the cassette 11 is shown with a top wall removed to illustrate details of the structure inside the cassette 11. The cassette 11 contains a first toothed feed roller 103 having a fixed axis of rotation and a second toothed feed roller 104 having a movable axis of rotation. The first feed roller 103 is secured to a vertical shaft 103*a* which extends through and is supported for rotation on the top and bottom walls of the cassette 11. Meanwhile, the second feed roller 104 is supported for rotation on a support member 104*a* which is mounted for back and forth movement on the lower casing of the cassette 11 and is urged rearwardly to engage the second feed roller 104 with the first feed roller 103 by means of a compression coil spring 104*b*. An endless fabric ink ribbon 102 going out from an exit opening 11*a* of the cassette 11 and returning within the cassette 11 through an entrance opening 11*b* may pass between the fixed and movable feed rollers 103 and 104 so that, if the feed roller 103 or 104 is rotated, the ribbon 102 is fed into a storage chamber 11*c* accordingly. The ribbon 102 is thus stored in the chamber 11*c* in a stuffed condition.

The shaft 103*a* further has a manually operable knob 103*b* mounted on the top end thereof and a gear 106 secured to the bottom end thereof. The gear 106 is meshed with another smaller gear 105*a* which is mounted for rotation on a plate member 105 by means of a pin 105*b*. The plate member 105 is mounted for pivotal motion about the shaft 103*a* between the gear 106 and the bottom wall of the cassette 11 and is urged clockwise (FIG. 10) about the shaft 103*a* by means of a tension coil spring 105*c* to a position in which an enlarged headed protrusion 105*d* at the free end thereof is abutted against the left end edge of a substantially T-shaped opening 11*d* formed in the bottom wall of the cassette 11.

The fabric ribbon cassette 11 can be mounted in position on the platform 9 in similar manner as the carbon ribbon cassette 10, and when it is so positioned and the lever 13 is in its first clockwise limit position, the gear 105*a* is in register and engaged with the gear 96 of the ribbon feed unit 15 as seen in FIG. 12 so that an angular counterclockwise rotation of the gear 96 rotates the gear 105*a* in the clockwise direction about the pin 105*b*. This rotation of the gear 105*b* rotates the first feed roller 103 a predetermined angle in the counterclockwise direction by way of the gear 106 thereby feeding, in cooperation with the second feed roller 104, the ribbon 102 a predetermined distance. Also, the spring 105*c* is designed to have a smaller force than the overcenter spring 13*b* so that, if the gear 105*b* is engaged by the gear 96 of the ribbon feed unit 15, the plate member 105 is yieldably pivoted a small angle about the shaft 103*a*.

CORRECTION RIBBON LIFT

Figure 7:
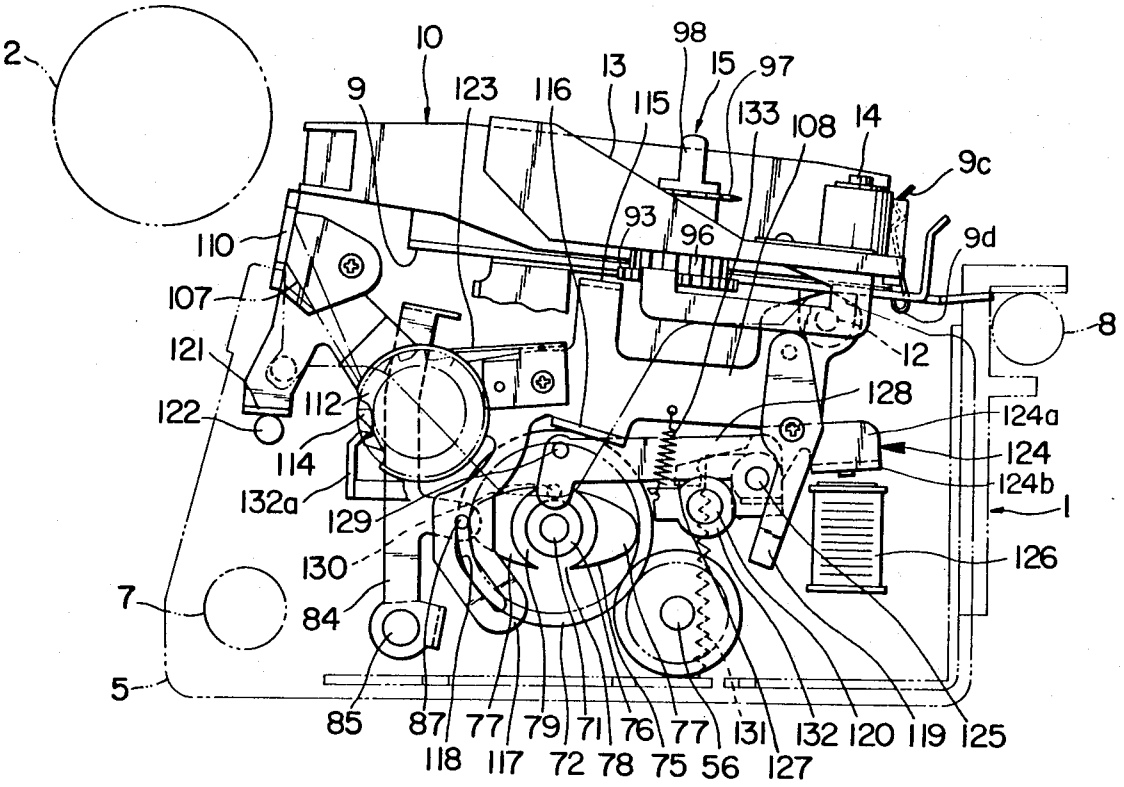
FIG. 7 is a left-hand side elevational view of the carrier, partly broken, showing details of correction ribbon feed and lift mechanisms with a left side plate of a carrier frame structure omitted to clarify geometric and operative relations among elements of the mechanisms.

Referring to FIGS. 1, 2 and 7, the ribbon feeding and lifting mechanism 16 includes an automatic error correction mechanism. The error correction mechanism includes left and right lift levers 108, 109 which are secured at forward ends thereof to the shaft 12 for rotation therewith and extend rearwardly along the left and right side plate 5, 6, respectively, outside the carrier frame. Each lift lever 108, 109 has a ribbon guide 110 or 111 mounted at a rear upper end thereof and a spool 112 or 113 supported at a lower portion thereof forwardly of the ribbon guide 110 or 111. The takeup spool 112 on the left lift lever 108 has a toothed periphery 114 which is resiliently engaged by a detent member in the form of a spring plate 123 secured to the lever 108. Thus, a correction ribbon 107 may extend and be fed from the supply spool 113 to the takeup spool 112 passing the right and left ribbon guides 111, 110.

The left lift lever 108 has at a rearward lower end thereof a bent lug 121 which normally bears against a pin 122 secured to the left side plate 5 to hold the lift levers 108, 109 to their home position. The lever 108 has at the top of an upward extension at a mid portion thereof another bent lug 115 which is located just below a horizontal portion of the member 80 secured to the platform 9 so that, if the lever 108 is pivoted clockwise (FIG. 7), it will engage at the bent lug 115 thereof with the member 80 to lift or pivot the platform 9 clockwise about the axis of the shaft 12. Such a clockwise pivotal motion of the lift lever 108 is limited by a pin 120 which is secured to the left side plate 5 and is so located that it may be abutted by a stop member 119 secured to a forward end portion of the lift lever 108 if the lever 108 tends to excessively pivot clockwise about the axis of the shaft 12.

The lift lever 108 has a further bent lug 116 formed at a portion thereof below the bent lug 115. The lug 116 is located in register with and in an upwardly spaced relationship to a pin 129 secured to a rear end portion of a cam follower lever 128 and extending transversely leftwardly through an opening (not shown) formed in the left side plate 5. The lever 128 has a forward end thereof mounted for pivotal motion on a pin 125 which is secured to and extends rightwardly from the left side plate 5. The cam follower lever 128 is urged counterclockwise about the pin 125 by a tension coil spring 131 and further has a cam follower pin 130 secured to a rear end portion thereof below the pin 129. The follower pin 130 extends rightwardly from the lever 128 towards the aforementioned correction cam 75.

The correction cam 75 has an elliptical side elevation as seen in FIG. 7 and has a circular groove 79 formed therein which defines a central circular section 76 and a pair of diametrically opposed substantially crescent-shaped sections 77 which define a pair of openings 78 therebetween. The follower pin 130 thus extends into the circular cam groove 79 and normally bears against the central cam section 76 below one of the openings 76 so that a clockwise pivotal motion of the lever 128 against the urging of the spring 131 will remove the follower pin 130 out of the cam groove 79.

A control lever 124 is also mounted at a mid portion thereof for pivotal motion on the pin 125. The control lever 124 is made of a ferromagnetic material and has at a forward end a first arm 124*a* thereof a bent lug 124*b* which is in a spaced opposed relationship to a solenoid 126 mounted on the carrier frame by a suitable means not shown. The control lever 124 has at an end of second arm thereof another bent lug 127 which underlies the lower edge of the cam follower lever 128 so that a clockwise pivotal motion of the control lever 124 will cause the bent lug 127 thereof to push up and pivot the follower lever 128 clockwise against the urging of the spring 131 to bring up the pin 130 out of the cam groove 79 through one of the openings 78 of the correction cam 75.

The left lift lever 108 further has a downward extension 117 forwardly of the takeup spool 112 thereon. The extension 117 has a guideway 118 in the form of an angular slot, and the pin 87 of the aforementioned lever 84 extends through the guideway 118. The guideway 118 has such a configuration that, in the latter half of a clockwise pivotal motion of the lift lever 108, it will cam the pin 87 to pivot the lever 84 counterclockwise about the pin 85 in FIG. 7, i.e., clockwise in FIG. 6, to bring the bent lug 86 (FIG. 6) of the lever 84 out of the locus of the bent lug 83 of the member 80 thereby to allow the platform 9 and the ribbon cassette 10 or 11 to be pivoted beyond the limited position to lift the correction ribbon 107 to a print position.

In operation, when an automatic error correcting operation is to be performed, the solenoid 126 is first energized and magnetically attracts the bent lug 124*b* of the first arm 124*a* of the control lever 124 to pivot the lever 124 and hence the cam follower lever 128 clockwise about the pin 120 to a position in which the cam follower pin 130 is above and outside the circular groove 79 of the correction cam 75 and the pin 129 of the lever 128 is engaged with the bottom face of the bent lug 116 of the left lift lever 108. Then the motor 24 is energized and thus the gear 72 is rotated a half rotation in the clockwise direction as in FIG. 7. At a first stage of the rotation, the pin 130 is engaged with the outer periphery of either one of the crescent-shaped cam sections 77 so that it is thereafter cammed by this cam section 77 to further pivot the follower lever 128 clockwise about the pin 125. This clockwise pivotal motion determined by the outer periphery of the correction cam 75 pivots the left lift lever 108 and the platform 9 (as well as the right lift lever 109) clockwise about the axis of the shaft 12 to lift a correction ribbon 107 to a print position thereby enabling a subsequent hammer operation for deleting or erasing an error character printed. After such a hammer operation, as the follower pin 130 follows the cam 75, the platform 9 and the lift levers 108, 109 are pivoted counterclockwise to their respective initial positions by the spring 82 while the cam follower lever 128 is pivoted counterclockwise by the spring 131. Near the end of the rotation, the cam follower pin 130 comes to the other of the openings 76 and is admitted therethrough into the cam groove 79 to allow the cam follower lever 128 to be pivoted back to its initial position by the spring 131 since the solenoid 126 is deenergized sufficiently before such a half rotation of the cam 75 is completed.

On the contrary, when not an automatic error correcting but a character printing operation is to be performed, the solenoid 126 is not energized. As a result, after rotation of the correction cam 75 has been initiated, the cam follower pin 130 still remains in the cam groove 79, resulting in no pivotal motion of the cam follower lever 128 as well as of the lift levers 108, 109 and the platform 9 during the cycle of operation.

CORRECTION RIBBON FEED

Referring to FIG. 7, a feed lever 132 (partly broken to clearly show details of the correct ribbon lift mechanism in FIG. 7) has a base end thereof mounted for pivotal motion on the pin 120 and is urged clockwise by means of a tension coil spring 133 extending between the feed lever 132 and the cam follower lever 128. The feed lever 132 has at the other end thereof a feed pawl 132*a* which is normally positioned adjacent the outer toothed periphery 114 of the takeup spool 112.

Upon clockwise pivotal motion of the lift levers 108, 109 and the platform 9, the feed lever 132 is also pivoted clockwise about the pin 120 by way of the spring 133 interposed between the levers 128 and 132. Due to the geometry of the locus of the takeup spool 112 and the locus of the feed pawl 132*a* upon such clockwise rotation of the lift lever 108 and the feed lever 132, respectively, the feed pawl 132*a* is engaged with a tooth of the spool 112 and rotates the spool 112 an angle corresponding to a tooth distance counterclockwise about its axis thereby feeding the correction ribbon 107 a predetermined length from the supply spool 113 to the takeup spool 112. On the other hand, during counterclockwise pivotal motion of the lift arm 108 and the feed lever 132, the feed pawl 132*a* is yielded by a subsenquent next tooth of the spool 112 to a position for preparation of a subsequent operation of the next tooth of the spool 112 since the takeup spool 112 is held from rotating in the opposite clockwise direction by means of the detent spring plate 123.

Figure 13:
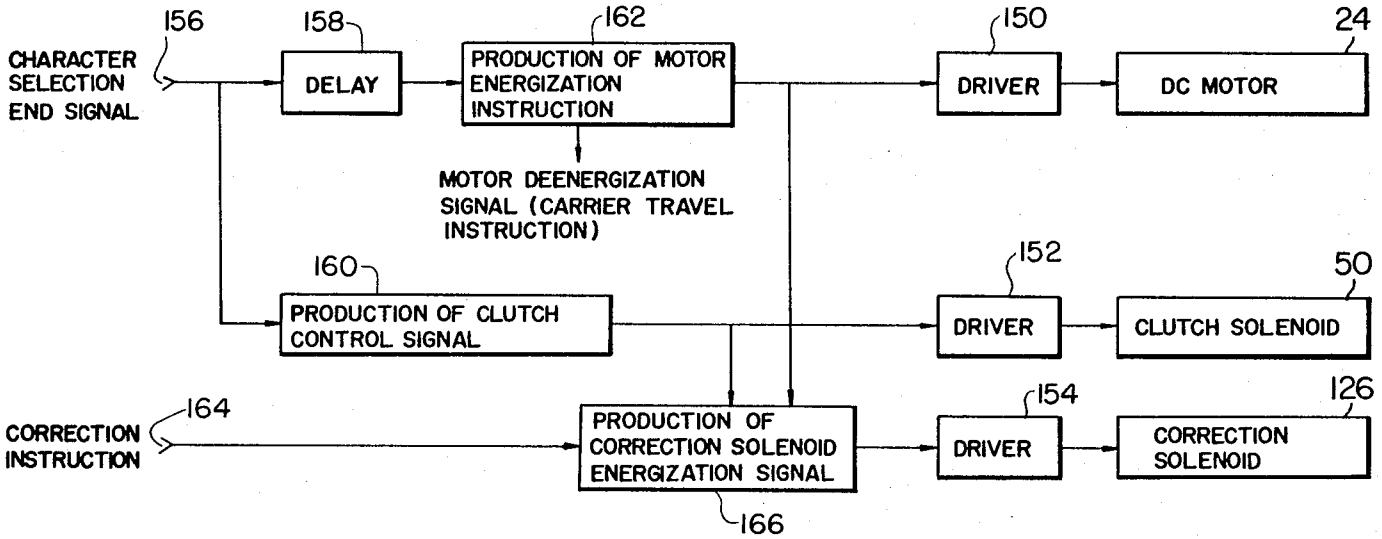
FIG. 13 is a diagrammatic representation of an exemplary control circuit for the typewriter including the drive mechanism according to the present invention.

An exemplary control circuit for the above described preferred embodiment is illustrated in FIG. 13 and shows the DC motor 24, the clutch solenoid 50, and the correction solenoid 126, each of which is connected to a respective driver 150, 152, and 154. A "character selection end signal" at an input 156 is presented to a delay circuit 158 and to a clutch control signal producing unit 160, which latter unit provides an appropriate signal through the driver 152 to the clutch solenoid 50 (FIG. 3) to initiate an operating cycle for the driving and driven members, 25 and 26, as described above. The delayed "character selection end signal" is provided to the motor energization unit 162, which, in turn, provides an appropriate signal through the driver 150 to energize the motor 24. A "correction solenoid instruction" at an input 164 is provided to a correction solenoid producing unit 166 which provides an appropriate energization signal through the driver 154 to the correction solenoid 126.

As can be appreciated, various changes and modifications may be made to the present invention without departing from the spirit and scope of the invention as defined in the appended claims and their legal equivalent.

I claim:

1. A drive mechanism for a typewriter having a member to be cyclically driven in one direction, comprising:

a first rotatable element;

a second rotatable element having a common axis of rotation with said first element and operatively coupled to said member;

an electric motor coupled to said first element and selectively energizable to rotate said first element in one direction for a cycle of operation of said member;

a clutch spring in continuous frictional engagement with said first and second elements such that said clutch spring only imparts rotation of said first element in said one direction relative to said second element and rotation of said second element in the opposite direction relative to said first element;

holding means having a first position in which said holding means positively holds said second element to a particular angular position about said axis and a second position in which said holding means releases said second element; and control means operable prior to and including initiation of energization of said motor to bring said holding means from said first to said second position and operable prior to and including completion of a cycle of rotation of said first element as well as said second element in said one direction to bring said holding means from said second to said first position to cause said second element as well as said first element to be positively held to a next particular angular position upon completion of the cycle of said rotation.

2. A drive mechanism as claimed in claim 1, wherein said clutch spring allows said first element to assume any angular position relative to said second position about said axis.

3. A drive mechanism as claimed in claim 2, wherein said clutch spring is so constituted as to provide a particular angular displacement between said first and second elements by each cycle of rotation of said second element.

4. A drive mechanism as claimed in claim 3, wherein said clutch spring is coiled around and has a relatively weak frictional engagement with portions of said first and second elements so as to provide said particular angular displacement between said first and second elements.

5. A drive mechanism as claimed in claim 1 or 2, wherein said motor is a bidirectional motor which may be energized again for a rather short period of time, after completion of one cycle of rotation of said second element, to rotate said first element in the opposite direction to provide an angular displacement of said first member relative to said second member in the opposite direction about said axis.

6. A drive mechanism as claimed in claim 1, 2, 3, or 4, wherein said motor is a small DC motor.

7. A drive mechanism as claimed in claim 1, 2, 3, or 4, wherein said holding means includes a first stop member mounted for engagement with said second element to positively stop rotation of said second element in said one direction, and a second stop member mounted for engagement with said second element to positively stop possible reactive rotation of said second element in the opposite direction when rotation of said second element in said one direction is stopped by said first stop member.

* * * * *